US008851826B2

(12) United States Patent
Nagata et al.

(10) Patent No.: US 8,851,826 B2
(45) Date of Patent: Oct. 7, 2014

(54) BUCKET AND WORK VEHICLE

(75) Inventors: Takanori Nagata, Dallas, TX (US); Kenichi Higuchi, Hirakata (JP); Masakuni Ueda, Wuxi (CN); Kouzou Ishida, Yawata (JP); Daijirou Itou, Hirakata (JP)

(73) Assignee: Komatsu Ltd., Tokyo (JP)

( * ) Notice: Subject to any disclaimer, the term of this patent is extended or adjusted under 35 U.S.C. 154(b) by 390 days.

(21) Appl. No.: 13/497,335

(22) PCT Filed: Oct. 19, 2010

(86) PCT No.: PCT/JP2010/068317

§ 371 (c)(1),
(2), (4) Date: Jul. 10, 2012

(87) PCT Pub. No.: WO2011/049061

PCT Pub. Date: Apr. 28, 2011

(65) Prior Publication Data

US 2012/0301258 A1 Nov. 29, 2012

(30) Foreign Application Priority Data

Oct. 20, 2009 (JP) ..... 2009-241134

(51) Int. Cl.
*E02F 3/00* (2006.01)
*E02F 3/40* (2006.01)

(52) U.S. Cl.
CPC ..... *E02F 3/40* (2013.01)
USPC ..... 414/722; 414/723

(58) Field of Classification Search
CPC ..... E02F 3/40; E02F 3/8152
USPC ..... 414/722, 723
See application file for complete search history.

(56) References Cited

U.S. PATENT DOCUMENTS

| | | | | | |
|---|---|---|---|---|---|
| 4,459,768 | A | * | 7/1984 | Albrecht | 414/722 |
| 5,815,959 | A | * | 10/1998 | Bahner et al. | 414/722 |
| 5,992,062 | A | * | 11/1999 | Evans et al. | 414/722 |
| 2011/0289803 | A1 | * | 12/2011 | Folkerts et al. | 37/444 |
| 2013/0323000 | A1 | * | 12/2013 | Rochel et al. | 414/722 |

FOREIGN PATENT DOCUMENTS

| | | | | |
|---|---|---|---|---|
| JP | 58-45760 | U | | 3/1983 |
| JP | 60-223534 | A | | 11/1985 |
| JP | 60223534 | A | * | 11/1985 |
| JP | 4-117046 | U | | 10/1992 |
| JP | 04117046 | U | * | 10/1992 |
| JP | 2002-201659 | A | | 7/2002 |
| JP | 2003-321848 | A | | 11/2003 |

OTHER PUBLICATIONS

International Search Report of corresponding PCT Application No. PCT/JP2010/068317.

* cited by examiner

*Primary Examiner* — Gerald McClain
(74) *Attorney, Agent, or Firm* — Global IP Counselors, LLP

(57) ABSTRACT

A bottom surface part of a bucket includes first and second curved surface parts. The second curved surface part is positioned closer to a back surface part than the first curved surface part. A second curvature radius of the second curved surface part is shorter than a first curvature radius of the first curved surface part. The center of the first curvature radius is positioned to the outside of a main bucket body when viewed from the side. In a horizontal state, the first curved surface part is arranged along or above a reference curved surface when viewed from the side. A connecting part between the first curved surface part and the second curved surface part is positioned more towards a lip part than the portion of the bottom surface part that is positioned lowest in the bottom surface part in the horizontal state when viewed from the side.

7 Claims, 11 Drawing Sheets

BUCKET AND WORK VEHICLE

CROSS-REFERENCE TO RELATED APPLICATIONS

This application claims priority to Japanese Patent Application No. 2009-241134 filed on Oct. 20, 2009, the disclosure of which is hereby incorporated herein by reference in its entirety.

TECHNICAL FIELD

The present invention relates to a bucket and a work vehicle.

BACKGROUND ART

A bucket mounted on a work vehicle is provided with a plurality of teeth, a bracket, and a main bucket body. The teeth are provided on the upper part of the front side of the main bucket body. The bracket is provided on the back surface part of the main bucket body. An aperture is provided in the bracket, and a mounting pin is passed through the aperture to thereby attach the bucket to the arm. The bucket is thereby attached to the arm so as to be capable of pivoting about the mounting pin.

The main bucket body also has a box shape that is open on one face so as to allow soil to be placed therein. The bottom surface part of the main bucket body has a curved shape (see Japanese Patent Application Publication No. 2003-321848).

SUMMARY

When excavating with the bucket, the arm pivots, whereby the bucket pivots about the aperture in the above-described bracket while the entire bucket moves. The tips of the teeth move in an arcuate trajectory (see the two-dot chain line T101 in FIG. 8). At this point, if the bottom surface part of the main bucket body is protruding lower than the trajectory of the tips of the teeth, the bottom surface part moves while being firmly pressed against the ground. In this case, considerable excavating resistance is generated on the bucket.

An object of the present invention is to provide a bucket and a work vehicle capable of reducing excavating resistance.

The bucket according to a first aspect of the present invention is a bucket attached to an arm of a work vehicle, comprising a main bucket body, a lip part, a bracket, and a cutting edge part. The main bucket body includes a bottom surface part, a back surface part, and a pair of side surface parts. The bottom surface part has a curved shape when viewed from the side. The back surface part is connected to the bottom surface part. The pair of side surface parts covers the sides of the space surrounded by the bottom surface part and the back surface part. The lip part is secured to the edge positioned on the side opposite from the back surface part on the main bucket body. The bracket includes an aperture for accommodating a mounting pin for mounting the bracket on an arm, and is secured to the back surface part. The cutting edge part is secured to the lip part. The bottom surface part includes a first curved surface part and a second curved surface part. The first curved surface part has a shape curved at a predetermined first curvature radius when viewed from the side. The second curved surface part is positioned closer to the back surface part than the first curved surface part, is connected to the first curved surface part, and has a shape curved at a second curvature radius that is less than the first curvature radius when viewed from the side. The center of the predetermined first curvature radius of the first curved surface part is positioned to the outside of the main bucket body when viewed from the side. The wrist radius is defined as the length of an imaginary line connecting the center of the aperture of the bracket and the tip of the cutting edge part when viewed from the side. The reference curved surface is defined as the imaginary curved surface that is in contact with the first curved surface part at the edge of the first curved surface part positioned on the lip part side and that has a shape that is curved at a curvature radius having the same length as the wrist radius when viewed from the side. In a state where the imaginary line is arranged horizontally and the bottom surface part is positioned below the imaginary line (hereinafter referred to as "horizontal state"), the first curved surface part is arranged along the reference curved surface or above the reference curved surface. A connecting part between the first curved surface part and the second curved surface part is positioned more towards the lip part than the portion of the bottom surface part that is positioned lowest on the bottom surface part in the horizontal state when viewed from the side.

The bucket according to a second aspect of the present invention is the bucket of the first aspect, wherein the main bucket body further includes a front surface part. The front surface part is a linearly shape as viewed from the side and is positioned between the lip part and the first curved surface part. The length of the front surface part is less than the length of the first curved surface part in the direction along the lip part as viewed from the side.

The bucket according to a third aspect of the present invention is the bucket of the first aspect and satisfies a relationship $0.59 \leq r/d \leq 1.0$, where d is the wrist radius and r is the first curvature radius.

The bucket according to a fourth aspect of the present invention is the bucket of the third aspect and satisfies a relationship $0.8 \leq r/d \leq 1.0$.

The bucket according to a fifth aspect of the present invention is the bucket of the first aspect, wherein an angle formed by the imaginary line and the back surface part is an obtuse angle when viewed from the side.

The bucket according to a sixth aspect of the present invention is the bucket of the first aspect, wherein the center of the predetermined first curvature radius of the first curved surface part is positioned higher than the aperture.

The bucket according to a seventh aspect of the present invention is the bucket of the sixth aspect, wherein the center of the predetermined first curvature radius of the first curved surface part is positioned rearward of the aperture.

The work vehicle according to an eighth aspect of the present invention comprises a main vehicle body, a boom attached to the main vehicle body, an arm attached to the boom, and the bucket according to any of the first through seventh aspects attached to the arm.

In the bucket according to the first aspect of the present invention, the reference curved surface is a curved surface approximated to the trajectory of the tip of the cutting edge part during excavating as described above. The first curved surface part is therefore arranged along or higher than the reference curved surface, whereby the contact pressure between the main bucket body and the ground can be reduced. Excavating resistance can thereby be reduced. The center of the curvature radius of the first curved surface part is positioned to the outside of the main bucket body when viewed from the side. Accordingly, a large curvature radius of the first curved surface part can be ensured. Soil can more freely flow into the main bucket body because a large second curved surface part can be ensured.

In the bucket according to the second aspect of the present invention, the lip part can be made short because the front surface part exists within the main bucket body. Accordingly, material costs can be reduced. The length of the front surface part is less than the length of the first curved surface part in the direction along the lip part when viewed from the side. Accordingly, a long first curved surface part can be ensured.

In the bucket according to the third aspect of the present invention, excavating resistance can be further reduced because the relationship between the wrist radius and the first curvature radius satisfies the expression described above.

In the bucket according to the fourth aspect of the present invention, excavating resistance can be further reduced because the relationship between the wrist radius and the first curvature radius satisfies the expression described above.

In the bucket according to the fifth aspect of the present invention, the shape of the space within the main bucket body in a horizontal state widens to the back surface side in progression to the bottom side. Accordingly, the capacity of the bucket can be increased.

In the bucket according to the sixth aspect of the present invention, a large curvature radius of the first curved surface part can be ensured.

In the bucket according to the seventh aspect of the present invention, a large curvature radius of the first curved surface part can be ensured.

In the work vehicle according to the eight aspect of the present invention, excavating resistance can be reduced when excavating operations are performed using the bucket.

DESCRIPTION OF EMBODIMENTS

First Embodiment

Figure 1:
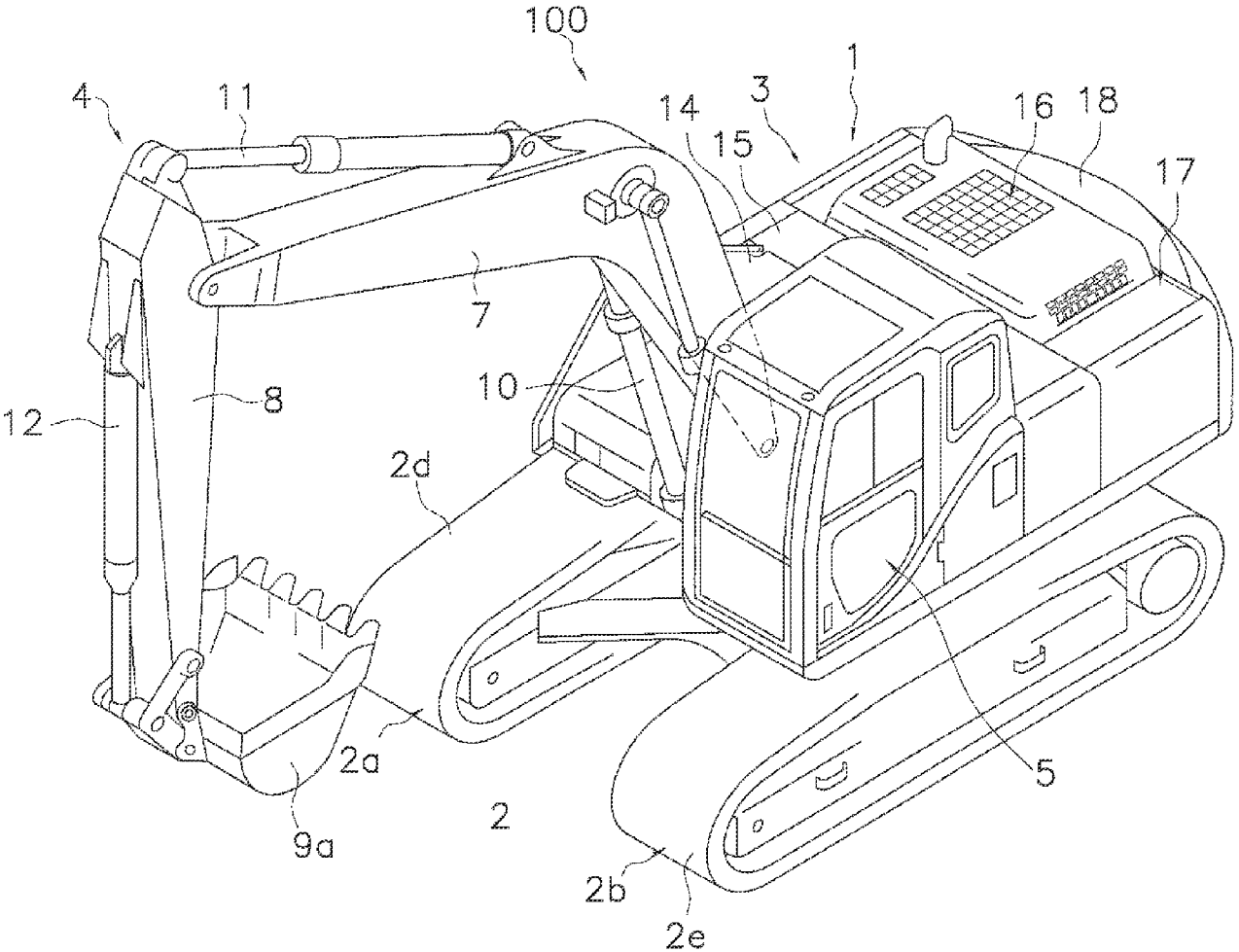
FIG. 1 is an outside perspective view of a hydraulic excavator according to an embodiment of the present invention.

A hydraulic excavator 100 according to the first embodiment of the present invention is shown in FIG. 1. The hydraulic excavator 100 is provided with a main vehicle body 1 and a work implement 4.

The main vehicle body 1 has a traveling unit 2 and a revolving unit 3. The traveling unit 2 has a pair of traveling devices 2*a* and 2*b*. The traveling devices 2*a* and 2*b* have crawler tracks 2*d* and 2*e*, and the crawler tracks 2*d* and 2*e* are driven by the driving force from the engine, whereby the hydraulic excavator 100 is made to travel. For the purposes of describing the entire configuration, front and back directions mean the front and back directions of the main vehicle body 1. Furthermore, left and right directions or side direction mean the vehicle width direction of the main vehicle body 1.

The revolving unit 3 is installed on the traveling unit 2. The revolving unit 3 is turnably provided to the traveling unit 2. An operator's cab 5 is further provided to the left side position of the front part of the revolving unit 3. The revolving unit 3 has a fuel tank 14, a hydraulic oil tank 15, an engine compartment 16, and an accommodation compartment 17. The fuel tank 14 stores fuel for driving an engine described below. The fuel tank 14 is arranged behind the hydraulic oil tank 15. The hydraulic oil tank 15 stores hydraulic oil that is discharged from a hydraulic pump (not shown) and fed to hydraulic cylinders 10 to 12. The engine compartment 16 accommodates the engine therein. The accommodation compartment 17 is arranged behind the operator's cab 5, and is arranged alongside the engine compartment 16 in the vehicle width direction. An accommodation space for accommodating a radiator and a radiator fan (not shown) for cooling the engine is provided inside the accommodation compartment 17. A counterweight 18 is provided behind the engine compartment 16 and the accommodation compartment 17.

The work implement 4 is attached at the center position of the front part of the revolving unit 3, and has a boom 7, an arm 8, and a bucket 9*a*. The base end part of the boom 7 is rotatably linked to the revolving unit 3. The tip part of the boom 7 is also rotatably linked to the base end part of the arm 8. The tip part of the arm 8 is rotatably linked to the bucket 9*a*. Hydraulic cylinders 10 to 12 (boom cylinder 10, arm cylinder 11, and bucket cylinder 12) are also arranged so as to correspond to the boom 7, arm 8, and bucket 9*a*, respectively. The work implement 4 is driven by the driving of the hydraulic cylinders 10 to 12. Excavating and other work are thereby performed.

Figure 2:
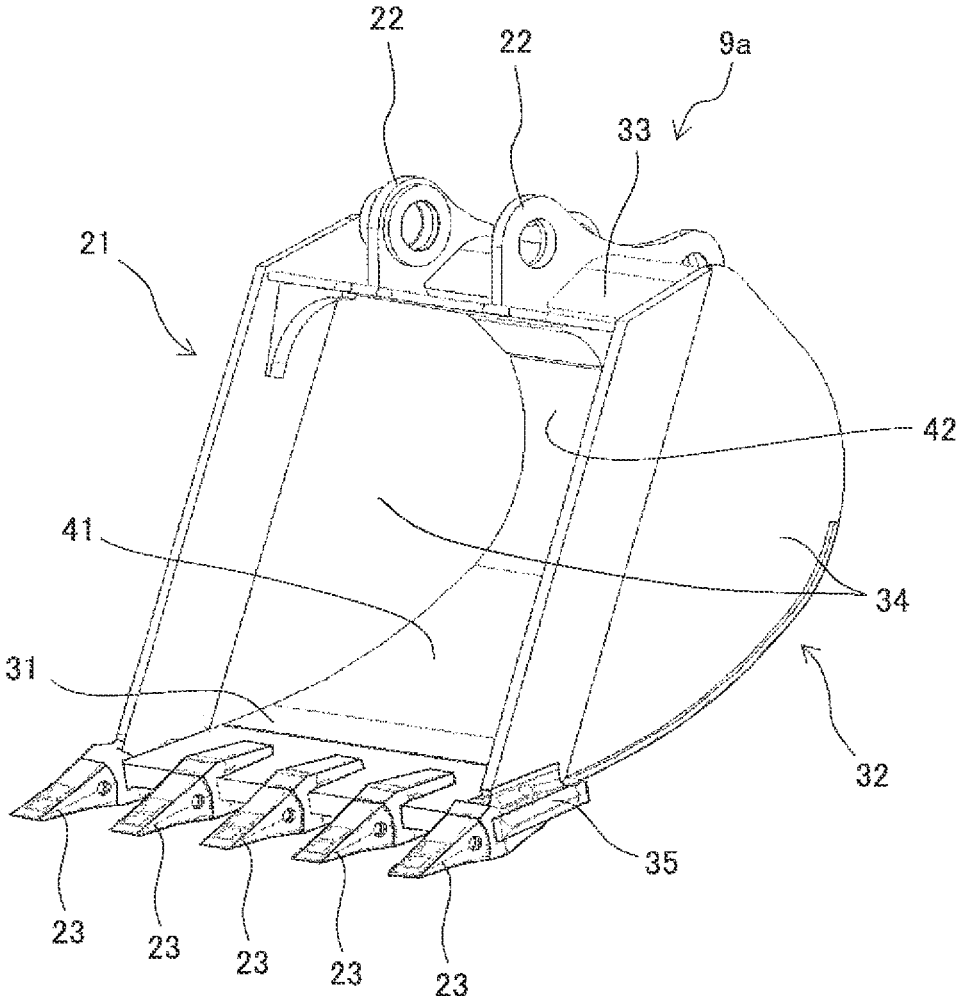
FIG. 2 is a perspective view of a bucket according to the first embodiment of the present invention.
Figure 3:
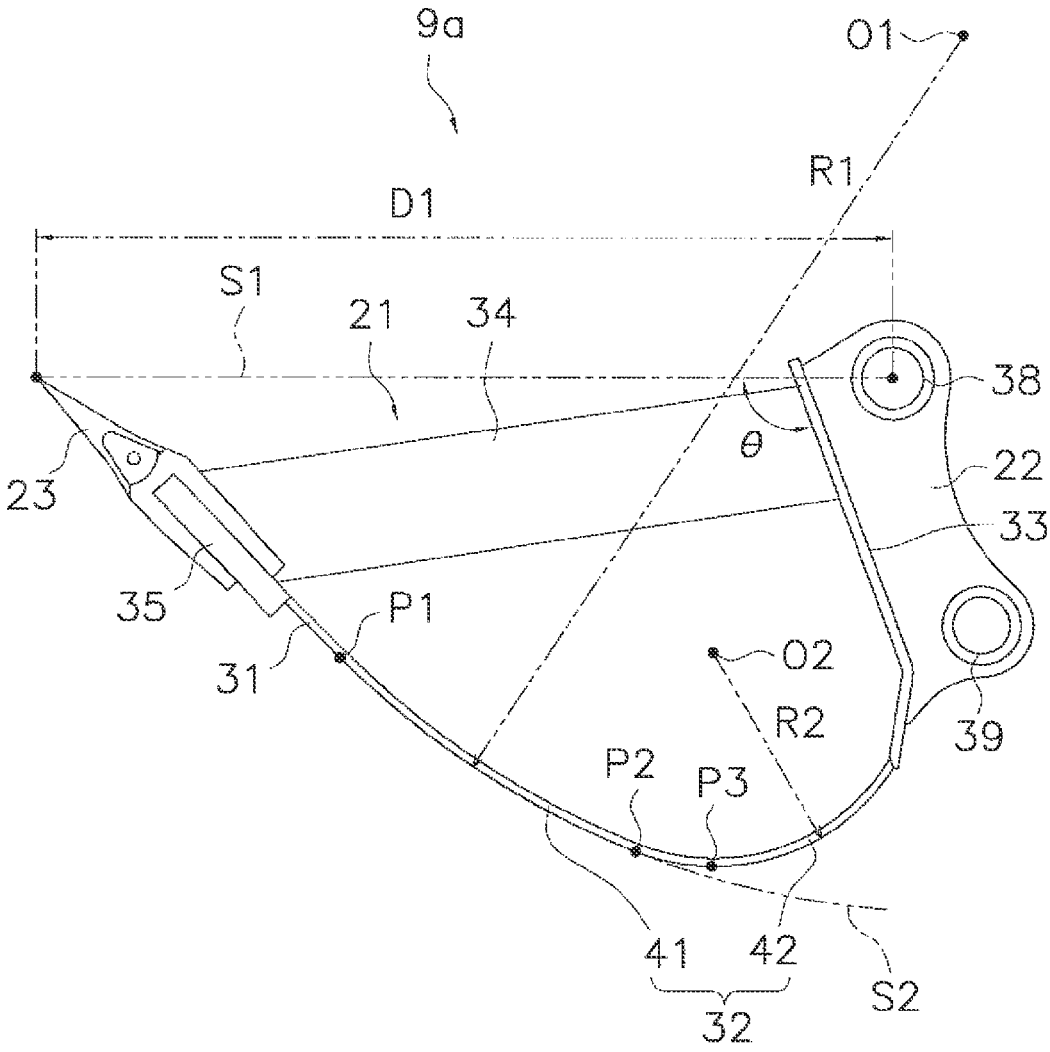
FIG. 3 is a side view of a bucket in a horizontal state.
Figure 4:
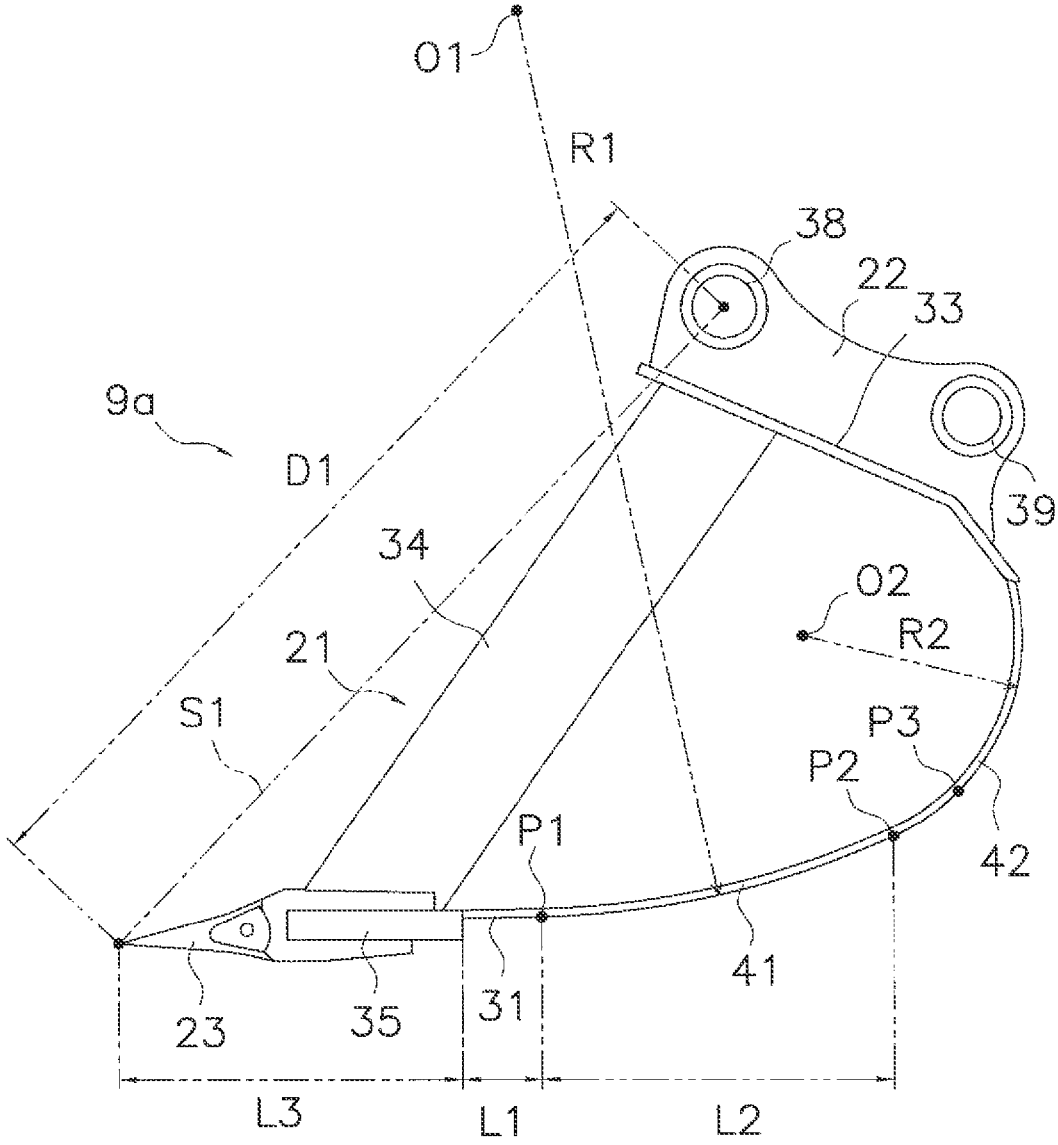
FIG. 4 is a side view of a bucket in a state in which the lip part is horizontally arranged.

As shown in FIGS. 2 to 4, the bucket 9*a* is provided with a main bucket body 21, a lip part 35, a bracket 22, and a plurality of teeth 23.

The main bucket body 21 has a front surface part 31, a bottom surface part 32, a back surface part 33, and a pair of side surface parts 34. The front surface part 31 is a flat, plate-shaped member and has a linear shape when viewed from the side. The bottom surface part 32 is a curved, plate-shaped member and has a curved shape that is convex toward the outside of the main bucket body 21 when viewed from the side. The bottom surface part 32 is connected to the front surface part 31. The back surface part 33 is a curved, plate-shaped member. The back surface part 33 is connected to the bottom surface part 32. The pair of side surface parts 34 is arranged at a distance from each other, and covers the sides of the space surrounded by the front surface part 31, the bottom surface part 32, and the back surface part 33.

The lip part 35 is a flat, plate-shaped member, and has a linear shape when viewed from the side. The lip part 35 is a part where a tooth adapter is attached, and where the teeth 23 are secured. The lip part 35 is secured to the edge positioned on the opposite side of the back surface part 33 of the main bucket body 21. Specifically, the lip part 35 is secured to the edge of the front surface part 31. The thickness of the lip part 35 is greater than the thickness of the front surface part 31.

The bracket 22 is a member for attaching the bucket 9*a* to the arm. The bracket 22 is secured to the back surface part 33. A first aperture 38 and a second aperture 39 are formed in the bracket 22. A mounting pin (not shown) for attaching the bracket 22 to the arm is passed through the first aperture 38. A mounting pin (not shown) for attaching the bracket 22 to the bucket cylinder 12 (see FIG. 1) is passed through the second aperture 39.

The plurality of teeth 23 are secured to the lip part 35. The teeth 23 are arranged along the edge of the lip part 35 with an interval between each tooth. The teeth 23 each have a tapered shape when viewed from the side.

A detailed description of the shape of the main bucket body 21 follows. In the description of the configuration of the bucket 9*a*, the side with the tips of the teeth 23 is referred to as "front" and the side with the first aperture 38 is referred to as "back" as shown in FIG. 3.

The bottom surface part 32 described above has a first curved surface part 41 and a second curved surface part 42. The first curved surface part 41 is connected to the front surface part 31. Therefore, the front surface part 31 is positioned between the first curved surface part 41 and the lip part 35. The first curved surface part 41 has a shape curved at a predetermined first curvature radius R1 when viewed from the side. The first curvature radius R1 is approximately the same length as the wrist radius D1 described below. The center O1 of the curvature radius of the first curved surface part 41 is positioned outside of the main bucket body 21. In the state shown in FIG. 3, the center O1 is positioned above and rearward of the center of the first aperture 38 when viewed from the side. The second curved surface part 42 is positioned more towards the back surface part 33 side i.e., rearward of the first curved surface part 41, and is connected to the first curved surface part 41. The second curved surface part 42 has a shape curved at a predetermined second curvature radius R2 when viewed from the side. The second curvature radius R2 is less than the first curvature radius R1. The center O2 of the curvature radius of the second curved surface part 42 is positioned inside the main bucket body 21.

The wrist radius D1 is defined as the length of an imaginary line S1 connecting the center of the first aperture 38 of the bracket 22 and the tip of the teeth 23 when viewed from the side. The reference curved surface S2 is defined as the imaginary curved surface that is tangent to the first curved surface part 41 at the tip of the first curved surface part 41 positioned on the lip part 35 side, in other words, the connecting part P1 between the front surface part 31 and the first curved surface part 41 and that has a shape that is curved at a curvature radius having the same length as the wrist radius D1 when viewed from the side. As shown in FIG. 3, the state in which the imaginary line S1 is arranged horizontally and the bottom surface part 32 is positioned below the imaginary line S1 is referred to a "horizontal state".

The first curved surface part 41 is arranged along the reference curved surface S2 when viewed from the side. The connecting part P2 between the first curved surface part 41 and the second curved surface part 42 is positioned more to the front, i.e., the front surface part 31 than the portion P3 that is the lowest position of the bottom surface part 32 in the horizontal state when viewed from the side. The portion P3 that is the lowest position of the bottom surface part 32 in the horizontal state is therefore included in the second curved surface part 42.

As shown in FIG. 4, the length of the front surface part 31, as viewed from the side, is less than the length of the first curved surface part 41 in the direction along the lip part 35. Specifically, the length L1 of the front surface part 31 in the direction along the lip part 35 is less than the length L2 of the first curved surface part 41 in the direction along the lip part 35. The length L1 of the front surface part 31 in the direction along the lip part 35 is less than the length L3 between the lip part 35 and teeth 23 in the direction along the lip part 35. The length of the front surface part 31 in the direction along the lip part 35 is less than the second curvature radius R2. As shown in FIG. 3, the connecting part P1 between the front surface part 31 and the first curved surface part 41 is positioned at approximately the same height as the center O2 of the curvature radius of the second curved surface part 42 in the horizontal state.

The angle θ formed by the imaginary line S1 and the back surface part 33, when viewed from the side, is an obtuse angle. The back surface part 33 is inclined so that the lower side is positioned more towards the back in the horizontal state. The upper part of the back surface part 33 is positioned forward of the first aperture 38 and the lower part of the back surface part 33 is positioned below the first aperture 38.

The ratio r/d of the wrist radius d and the first curvature radius r (hereinafter referred to as "wrist radius ratio") satisfies the expression in FORMULA 1 below.

$$0.59 \leq r/d \leq 1.0 \qquad \text{FORMULA 1}$$

In other words, $0.59 \leq R1/D1 \leq 1.0$. For example, R1=D1=1700 mm and, in this case, R1/D1=1.

Figure 5:
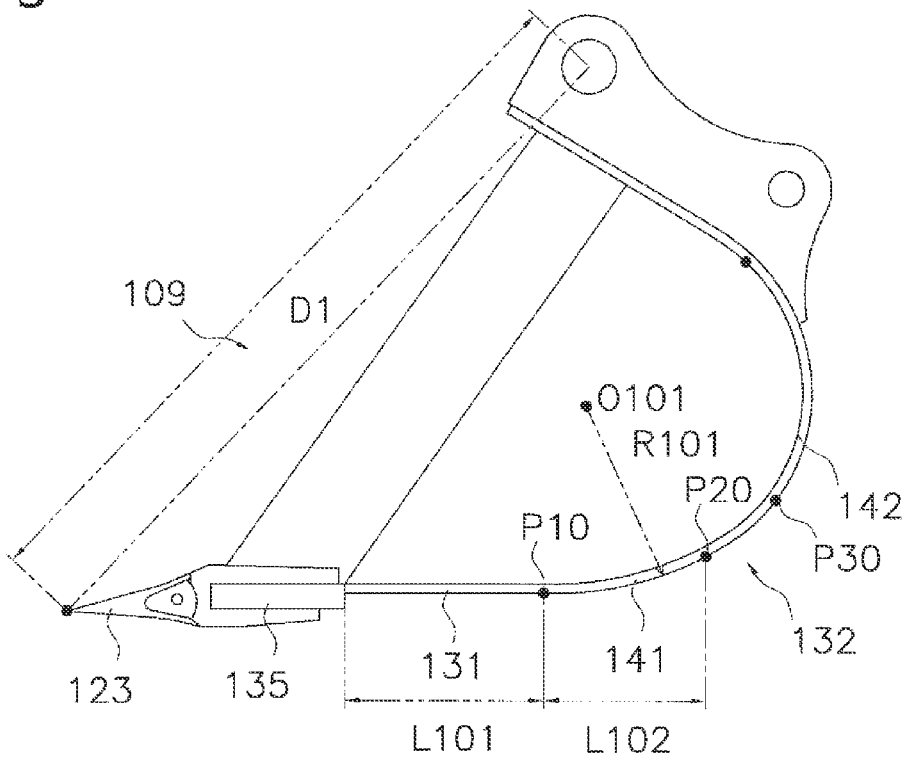
FIG. 5 is a side view of a bucket according to a comparative example.

Following is a description of the features of the bucket 9*a* according to the present embodiment in comparison with a bucket 109 according to a comparative example. FIG. 5 is a side view of the bucket 109 according to the comparative example. The bucket 109 according to the comparative example has the same wrist radius D1 as the bucket 9*a* according to the present embodiment. However, the curvature radius R101 of the first curved surface part 141 is less than the wrist radius D1, and the center O101 of the curvature radius R101 of the first curved surface part 141 is positioned inside the bucket 109 when viewed from the side. For example, D1=1700 mm, and R101=800 mm. In this instance, the wrist radius ratio D1/R101=0.47, and does not satisfy the expression in FORMULA 1 above.

The length L101 of the front surface part 131 of the bucket 109 according to the comparative example is greater than the length L1 of the front surface part 31 of the bucket 9*a* according to the present embodiment when viewed from the side. The length L101 of the front surface part 131 of the bucket 109 according to the comparative example is greater than the length L102 of the first curved surface part 141 along the direction of the lip part 135.

The front surface part 131 and the first curved surface part 141 are connected by a connecting part P10. The first curved surface part 141 and the second curved surface part 142 are connected by a connecting part P20. The portion P30 of the bottom surface part 132 that is positioned lowest in the horizontal state is included in the second curved surface part 142.

Figure 6:
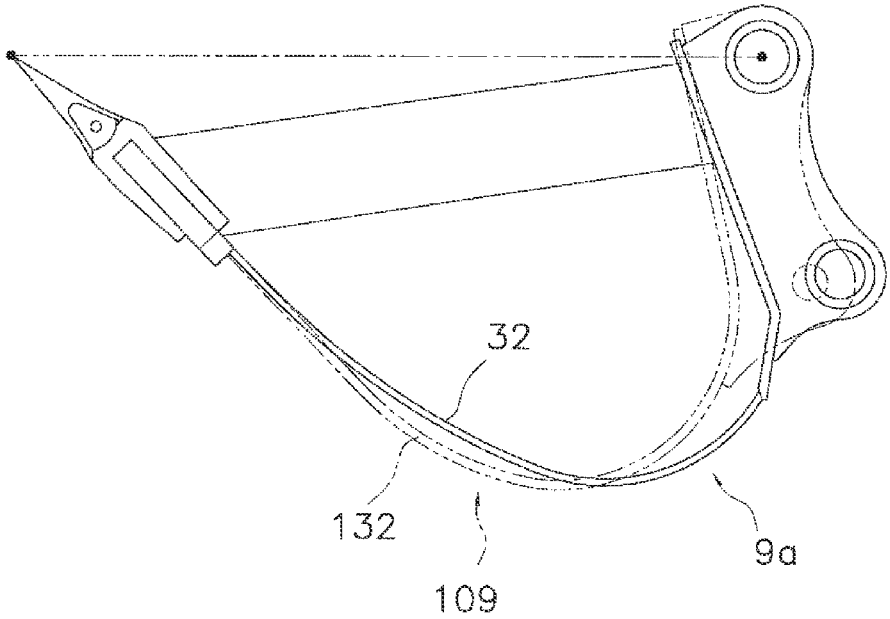
FIG. 6 is a side view showing a bucket according to the first embodiment and a bucket according to a comparative example.

FIG. 6 shows a diagram in which the bucket 9*a* according to the present embodiment is superimposed on the bucket 109 according to the comparative example is shown in FIG. 6. The slope of the bottom surface part 32 of the bucket 9*a* according to the present invention in relation to the horizontal direction in the horizontal state is more gradual in comparison with the bucket 109 according to the comparative example. The front portion of the bottom surface part 32 of the bucket 9*a* according to the present embodiment is positioned higher than the front portion of the bottom surface part 132 of the bucket 109 according to the comparative example. Accordingly, the contact pressure between the bottom surface part 32 of the bucket 9*a* and the ground can be reduced and excavating resistance can be reduced with the bucket 9*a* according to the present embodiment.

In the bucket 9*a* according to the present embodiment, the first curved surface part 41 is arranged along the reference curved surface S2. The reference curved surface S2 is a curved surface that approximates the trajectory of the tip of the teeth 23 during excavating. Accordingly, the contact pressure between the bottom surface part 32 and the ground can be reduced by having the first curved surface part 41 arranged along the reference curved surface S2.

Figure 7:
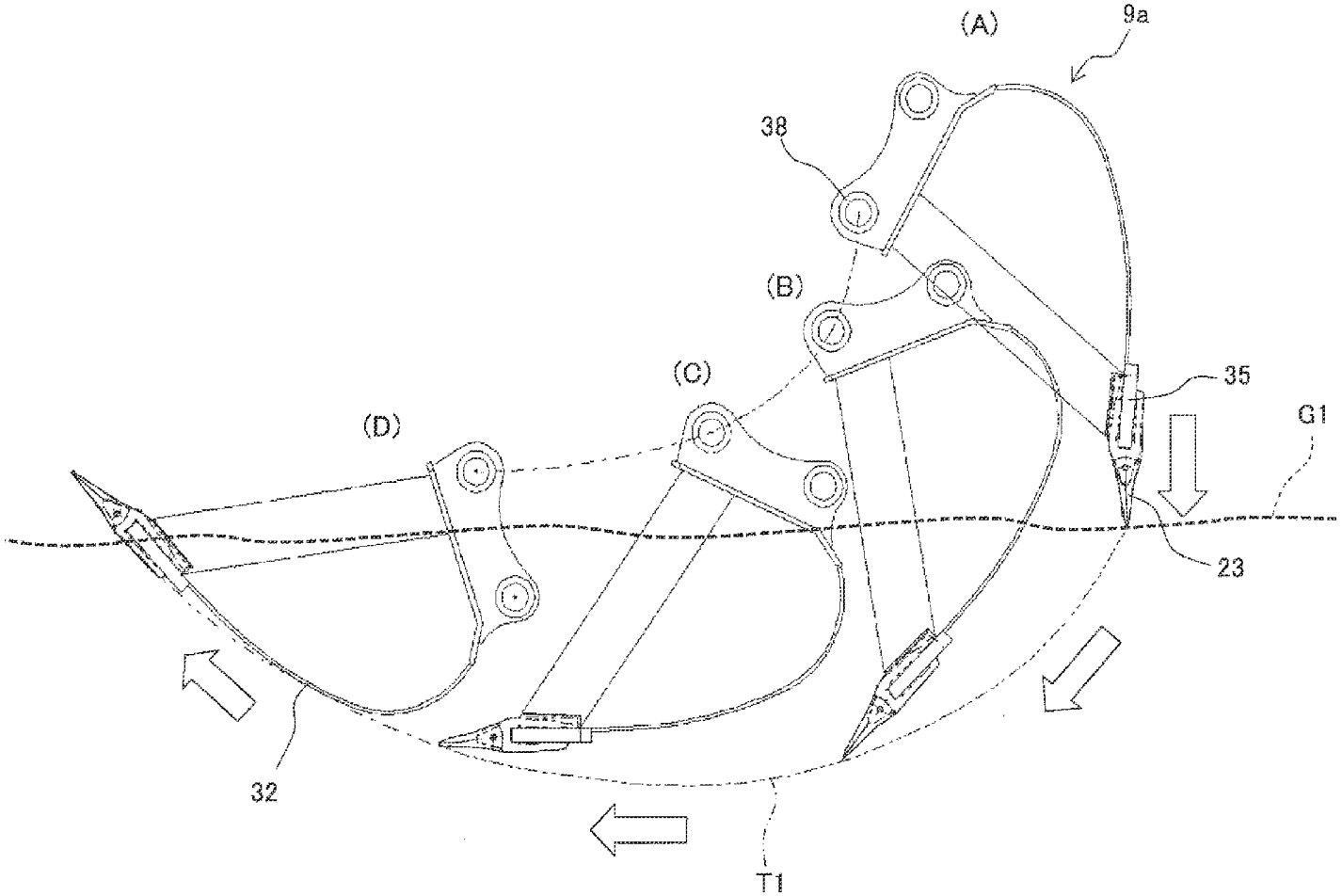
FIG. 7 is a diagram showing the trajectory of a bucket according to the first embodiment.

FIG. 7 shows the trajectory of the bucket 9*a* during excavating in which the bucket 9*a* according to the present embodiment is moved while the arm 8 (see FIG. 1) is moved. The arrow in the drawing shows the direction of progression of the bucket 9*a*. The dotted line G1 shows the ground. The two-dot chain line T1 shows the trajectory T1 of the tip of the teeth 23. As used herein, the term "penetrate" refers to the motion of the bucket 9*a* from a state in which the bucket 9*a* has not entered the ground and the tip of the teeth 23 is in contact with the ground (state (A) in FIG. 7) to a state where the teeth 23 enter the ground (state (B) in FIG. 7) and the teeth 23 are in a horizontal position in the ground (state (C) in FIG. 7). The term "excavating" refers to the motion of the bucket 9*a* from the state in which the teeth 23 have penetrated the ground and are in a horizontal position (state (C) in FIG. 7) to a state where the bucket 9*a* is in the horizontal state and the tip of the teeth 23 are showing above the ground. The swing of the arm 8 during excavating is of sufficient magnitude that the position of the first aperture 38 after moving does not exceed the position of the tip of the teeth 23 before moving. In the bucket 9*a* according to the present embodiment, the bottom surface part 32 follows the trajectory T1 of the tip of the teeth 23 in the state (D), as shown in FIG. 7. Accordingly, the contact pressure between the ground and the bottom surface part 32 of the bucket 9*a* during excavating can be reduced and excavating resistance can be reduced.

Figure 8:
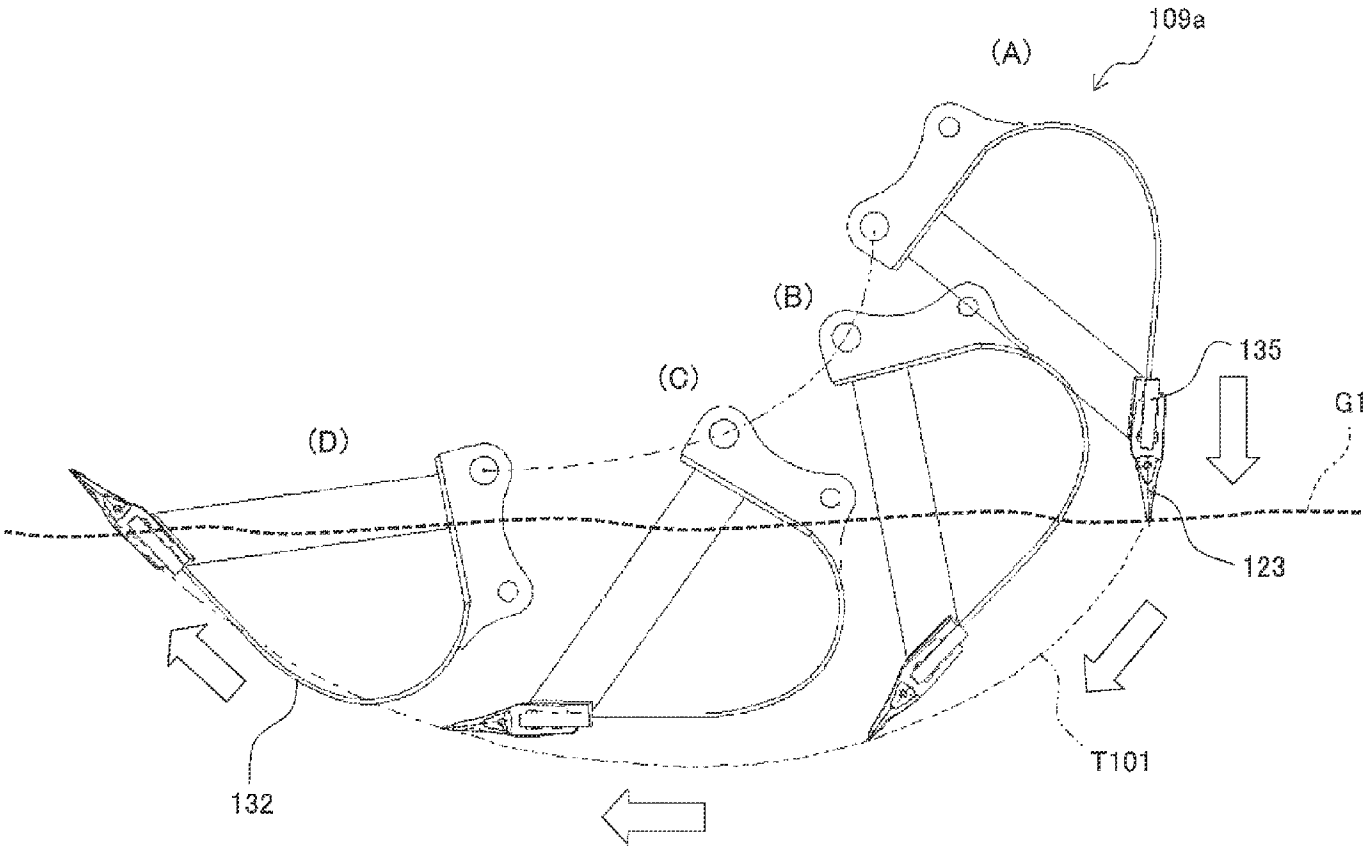
FIG. 8 is a diagram showing the trajectory of a bucket according to a comparative example.

FIG. 8 shows the trajectory of the bucket 109 when the bucket 109 is moved while the arm 8 is moved with the bucket 109 according to the comparative example. The swing of the arm 8 in excavating (motion from state (C) to state (D) in FIG. 8) is the same as in FIG. 7. The two-dot chain line T101 in FIG. 8 shows the trajectory T101 of the tip of the teeth 23. With the bucket 109 according to the comparative example, a portion of the bottom surface part 132 protrudes below the trajectory T101 of the tip of the teeth 123 in the state (D), as shown in FIG. 8. Therefore, with the bucket 109 according to the comparative example, the contact pressure between the ground and the bottom surface part 132 of the bucket 109 during excavating becomes greater and excavating resistance becomes greater.

In the bucket 9*a* according to the present embodiment, the angle θ formed by the imaginary line S1 and the back surface part 33 is an obtuse angle when viewed from the side. Accordingly, the space inside the main bucket body 21 in the horizontal state has a shape that widens to the rear in progression to the bottom side. Accordingly, broad space toward the rear in the main bucket body 21 is ensured. Accordingly, the capacity of the bucket 9*a* can be increased.

In the bucket 9*a* according to the present embodiment, the connecting part P2 between the first curved surface part 41 and the second curved surface part 42 is positioned forward of the portion P3 of the bottom surface part 32 that is positioned lowest in the horizontal state when viewed from the side. In other words, the bucket 9*a* according to the present embodiment has a larger first curved surface part 41 in comparison to the bucket 109 according to the comparative example, and the second curved surface part 42 is ensured to be large without being made excessively small. Accordingly, Soil can more readily flow into the main bucket body 21.

In the bucket 9*a* according to the present embodiment, the length of the front surface part 31 is less than the length of the first curved surface part 41 in the direction along the lip part 35. Accordingly, the lip part 35 can be made shorter. Since the lip part 35 is more thickly formed than the front surface part 31 in order to increase strength, the cost of manufacturing increases as the length of the lip part 35 is increased. The cost of manufacturing can therefore be reduced by making the lip part 35 shorter. When the bottom surface part 32 is formed by rolling plate, a portion that is not rolled can be directly used as the front surface part 31. Accordingly, the yield rate of material can be increased.

Second Embodiment

Figure 9:
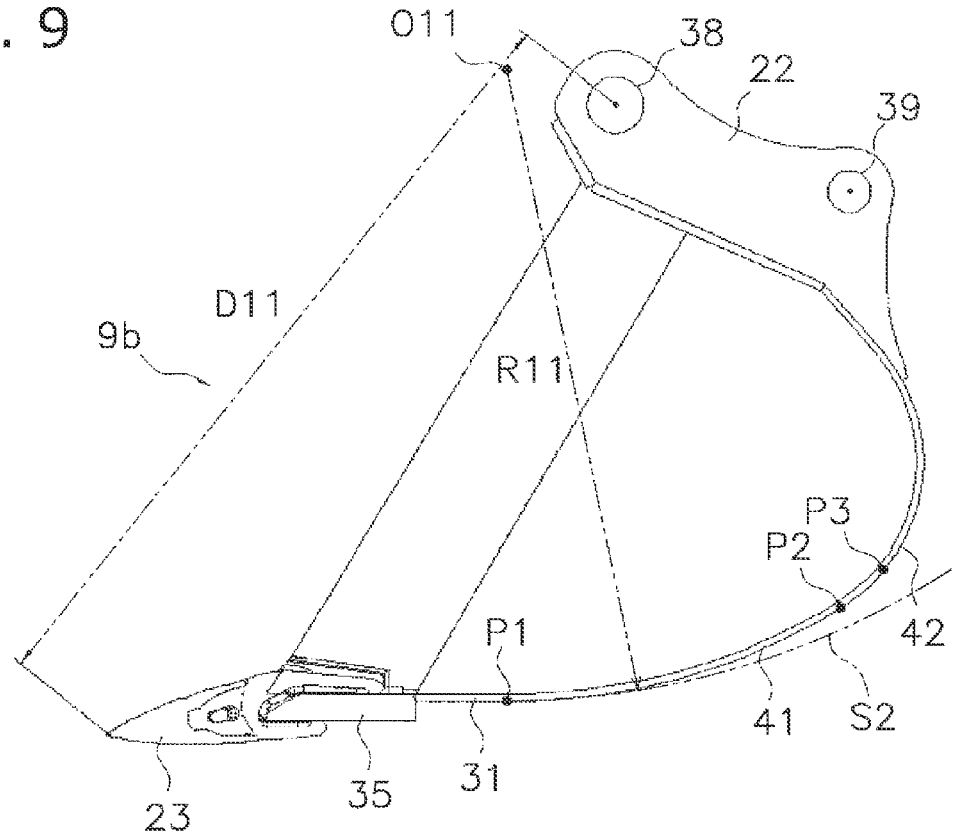
FIG. 9 is a side view of a bucket according to the second embodiment.

FIG. 9 shows a bucket 9*b* according to a second embodiment of the present invention. In the bucket 9*b*, the center O11 of the first curvature radius R11 of the first curved surface part 41 is positioned outside the bucket 9*b* in the same manner as the first embodiment. The wrist radius ratio R11/D11 also satisfies the expression in FORMULA 1 above. However, the first curvature radius R11 is less than the wrist radius D11. For example, R11=1700 mm and D11=2200 mm. In this case, the wrist radius ratio R11/D11=0.77. The first curved surface part 41 is also arranged higher than the reference curved surface S2 when viewed from the side.

The configuration is otherwise the same as the bucket 9*a* according to the first embodiment. The same effect as that of the bucket 9*a* according to the first embodiment can be obtained with the bucket 9*b* according to the present embodiment.

Third Embodiment

Figure 10:
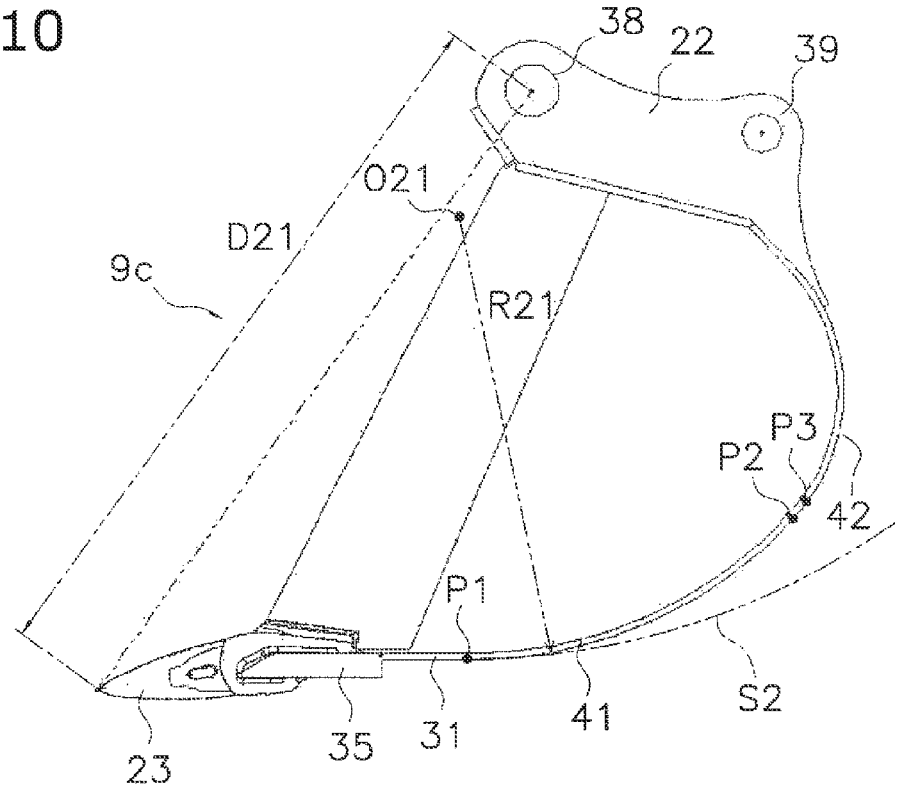
FIG. 10 is a side view of a bucket according to the third embodiment.

FIG. 10 shows a bucket 9*c* according to a third embodiment of the present invention. In this bucket 9*c*, the center O21 of the first curvature radius R21 of the first curved surface part 41 is positioned outside the bucket 9*c* in the same manner as the first embodiment. The wrist radius ratio R21/D21 also satisfies the expression in FORMULA 1 above. However, the first curvature radius R21 is shorter than the wrist radius D21. For example, R21=1300 mm and D21=2200 mm. In this case, the wrist radius ratio R21/D21=0.59. The first curved surface part 41 is also arranged higher than the reference curved surface S2 when viewed from the side.

The configuration is otherwise the same as the bucket 9*a* according to the first embodiment. The same effect as that of the bucket 9*a* according to the first embodiment can be obtained with the bucket 9*c* according, to the present embodiment.

Fourth Embodiment

Figure 11:
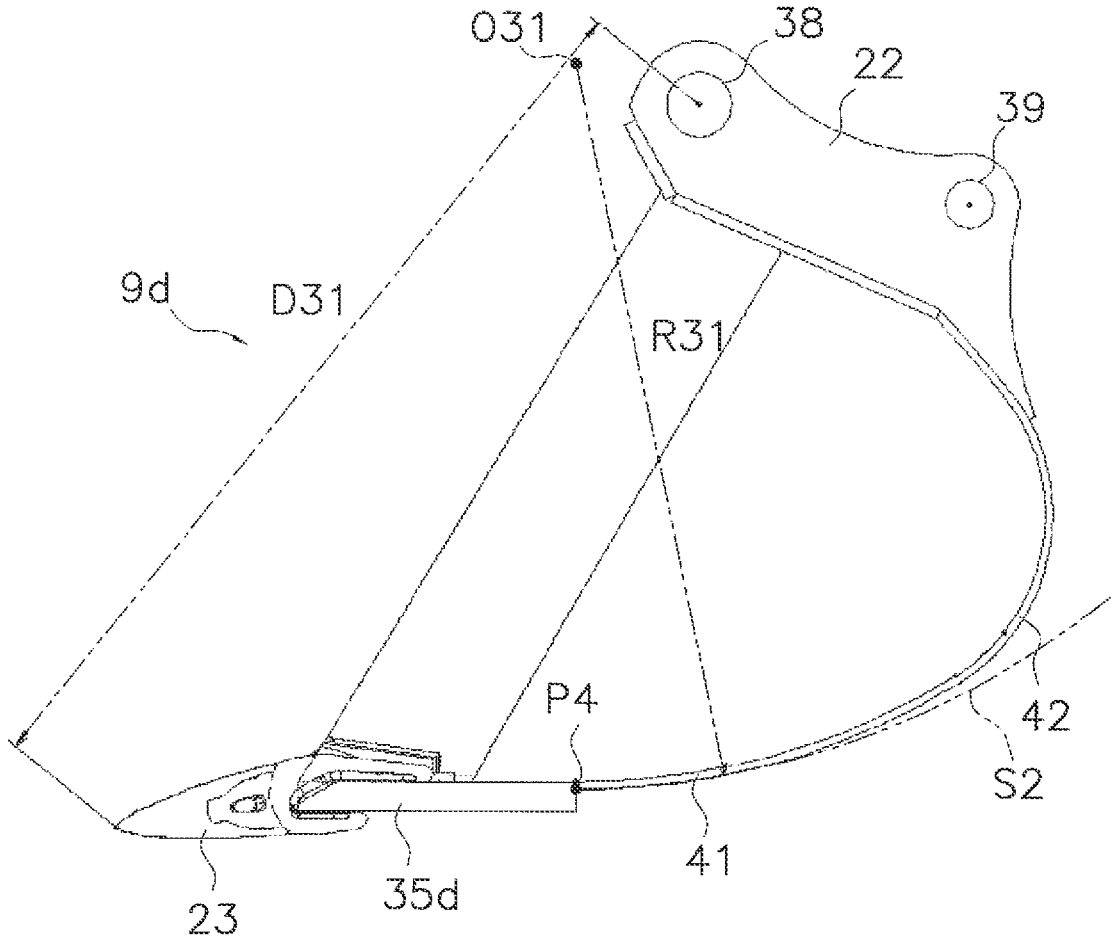
FIG. 11 is a side view of a bucket according to the fourth embodiment.

FIG. 11 shows a bucket 9*d* according to a fourth embodiment of the present invention. In this bucket 9*d*, the center O31 of the first curvature radius R31 of the first curved surface part 41 is positioned outside the bucket 9*d*. The wrist radius ratio R31/D31 satisfies the expression in FORMULA 1 above. The first curvature radius R31 is also less than the wrist radius D31. For example, R11=1700 mm and D11=2200 mm. In this case, the wrist radius ratio R31/D31=0.77. The first curved surface part 41 is also positioned higher than the reference curved surface S2 when viewed from the side.

In this bucket 9*d*, however, the front surface part 31 is not provided and the first curved surface part 41 is connected to the lip part 35*d*. The reference curved surface S2 is therefore tangent to the first curved surface part 41 at the end of the first curved surface part 41 positioned on the lip part 35*d* side, in other words, at the connecting part P4 between the lip part 35*d* and the first curved surface part 41 when viewed from the side. The length of the lip part 35*d* of the bucket 9*d* also corresponds to the combined length of the lip part 35 and the front surface part 31 of the bucket 9*b* of the second embodiment. In other words, the bucket 9*d* has a shape in which the front surface part 31 of the bucket 9*b* of the second embodiment is eliminated and the lip part 35 is extended to the end of the first curved surface part 41.

The configuration is otherwise the same as the bucket 9*a* according to the first embodiment. The same effect as that of the buckets 9*a* to 9*c* according to the embodiments described above can be obtained with the bucket 9*d* according to the present embodiment. However, the length of the lip part 35*d* in the present embodiment is greater than the length of the lip part 35 of the other embodiments. The thickness of the lip part must be made thicker than the other portions of the main bucket body 21 to ensure a high level of strength. Accordingly, material costs are increased as the length of the lip part is increased, and manufacturing costs are increased. Thus, from the perspective of reducing manufacturing costs, it is desirable for the lip part to be short as in the buckets 9*a* to 9*c* of the embodiments described above.

EXAMPLES

Examples of the present invention are described below. The relationship between the wrist radius ratio r/d and the excavating resistance ratio was examined for a plurality of samples shown in TABLE 1 below.

TABLE 1

| | Symbol | Wrist radius ratio r/d | Excavating resistance ratio | d [mm] | r [mm] |
|---|---|---|---|---|---|
| Example 1 | A | 1.00 | 0.8 | 1700 | 1700 |
| Example 2 | B | 0.71 | 0.81 | 1700 | 1200 |
| Example 3 | C | 0.77 | 0.8 | 2200 | 1700 |
| Example 4 | D | 0.59 | 0.85 | 2200 | 1300 |
| Comparative Example 1 | E | 0.47 | 1 | 1700 | 800 |
| Comparative Example 2 | F | 0.35 | 1.05 | 1700 | 600 |
| Comparative Example 3 | G | 0.24 | 1.2 | 1700 | 400 |
| Comparative Example 4 | H | 0.30 | 1 | 2200 | 650 |

Each sample in TABLE 1 has a different wrist radius d and a different first curvature radius r. Example 1, example 2, and comparative examples 1 to 3 have bucket capacities of 1.4 $m^3$. Examples 3 and 4 and comparative example 4 have bucket capacities of 4 $m^3$. In regards to the shape of the buckets in each example, example 1 corresponds to the bucket 9*a* of the first embodiment described above. Example 2 and example 3 correspond to the bucket 9*b* of the second embodiment described above. Example 4 corresponds to the bucket 9*c* of the third embodiment described above. Comparative examples 1 to 4 correspond to the bucket 109 of the comparative example described in the first embodiment.

The excavating resistance ratio is prescribed below. First, the hydraulic energy is calculated from the hydraulic pressure and stroke of the arm cylinder 11 and the bucket cylinder 12 described above for each comparative example. In this case, the excavating resistance can be considered the hydraulic energy. Also, the hydraulic energy for each example is calculated in the same manner. For the samples with bucket capacities of 1.4 $m^3$, the hydraulic energy for each sample in relation to the hydraulic energy of comparative example 1 was used as the excavating resistance ratio. For the samples with bucket capacities of 4 $m^3$, the hydraulic energy for each sample relative to the hydraulic energy of comparative example 4 was used as the excavating resistance ratio. In other words, normalized values were used for convenience because the absolute value of hydraulic energy varies with the bucket capacity.

Figure 12:
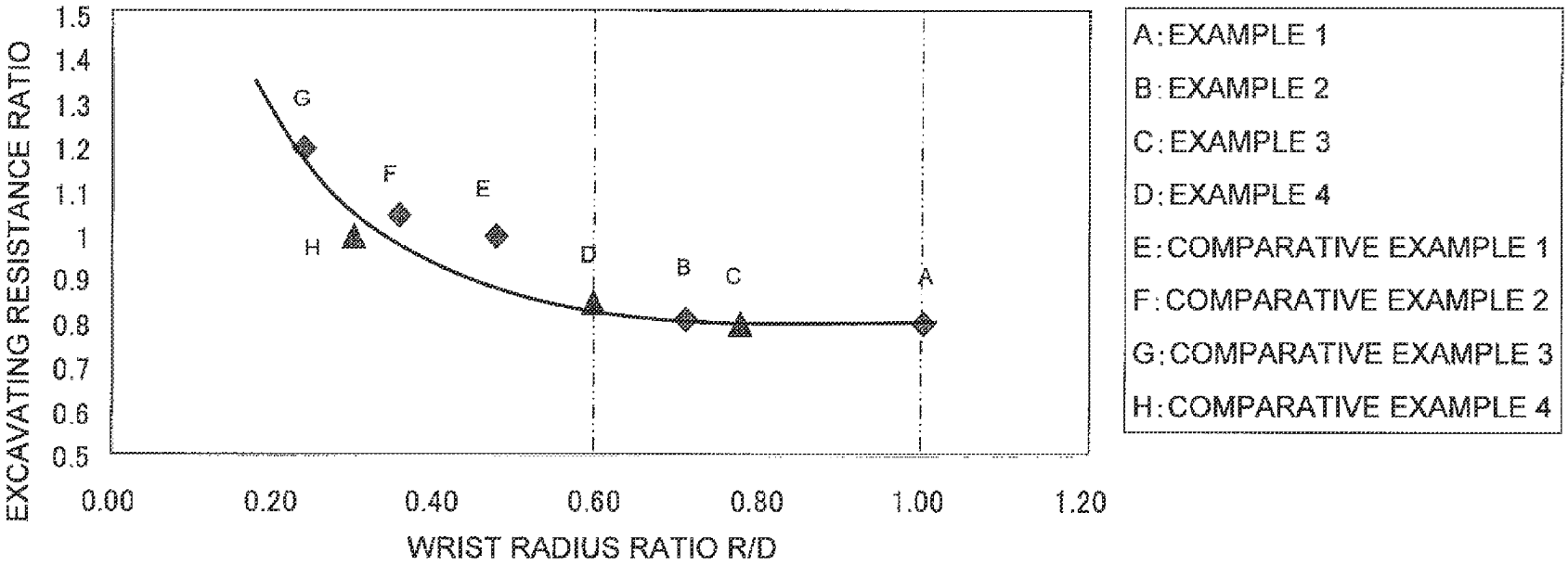
FIG. 12 is a graph showing the relationship between the wrist radius ratio and the excavating resistance ratio.

The relationship between the wrist radius ratio r/d and the excavating resistance ratio for each sample is shown in FIG. 12. In the graph in FIG. 12, the horizontal axis shows the wrist radius ratio r/d and the vertical axis shows the excavating resistance ratio. The reference symbols A to H shown in the graph correspond to the symbols A to H in TABLE 1. As it is apparent from the graph, the excavating resistance ratio increases dramatically when the wrist radius ratio r/d is less than 0.59. It is therefore preferred that the wrist radius ratio r/d satisfies the expression described above in FORMULA 1. It is more preferred that the wrist radius ratio r/d satisfy the expression of FORMULA 2 below.

$$0.8 \leq r/d \leq 1.0 \qquad \text{FORMULA 2}$$

Other Embodiments

Embodiments of the present invention are described above. However, the present invention is not limited to the embodiments described above, and a wide variety of modifications can be made without departing from the scope of the invention. For example, the relationships between the positions and dimensions of each portion of the buckets 9*a* to 9*d* can be modified without being limited to the embodiments described above.

Figure 13:
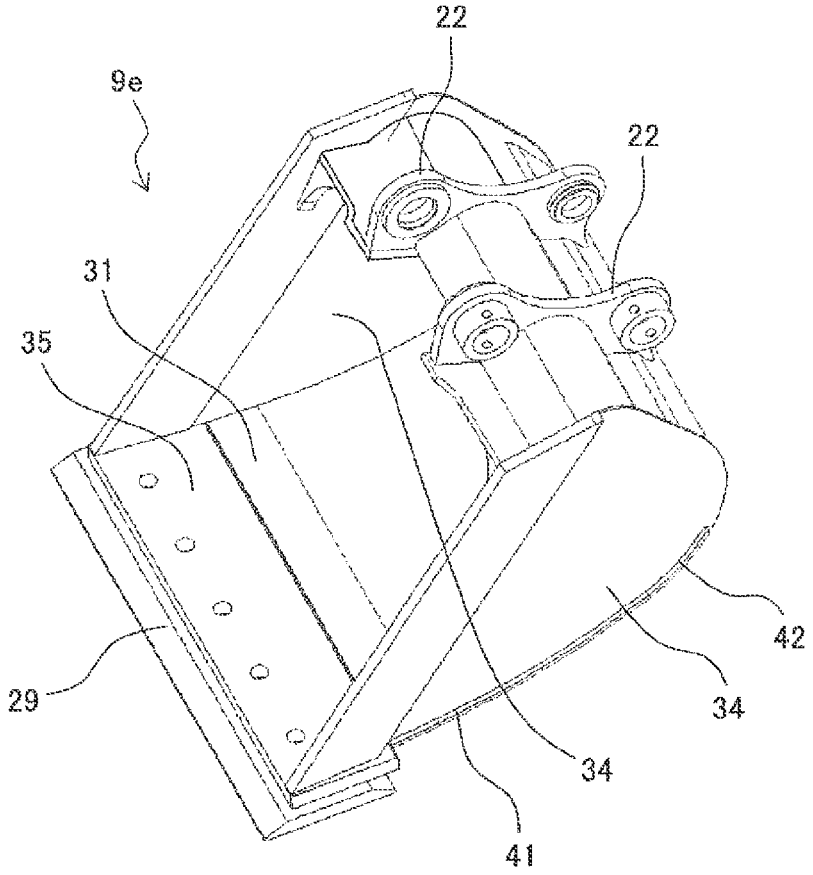
FIG. 13 is a perspective view of a bucket according to another embodiment.

A plurality of teeth 23 is provided as cutting edge part in the buckets 9*a* to 9*d* in the embodiments described above, but a cutting edge 29 may also be provided in the manner of the bucket 9*e* shown in FIG. 13.

The arrangements described in the illustrated embodiments have an effect of being capable of reducing excavating resistance, and are useful for buckets and work vehicles.

The invention claimed is:

1. A bucket adapted to be attached to an arm of a work vehicle, comprising:

a main bucket body including a bottom surface part having a curved shape when viewed from the side, a back surface part connected to the bottom surface part, and a pair of side surface parts covering the sides of a space surrounded by the bottom surface part and the back surface part;

a lip part secured to an edge positioned on the opposite side of the back surface part of the main bucket body;

a bracket secured to the back surface part, the bracket including an aperture for accommodating a mounting pin for mounting the bracket to the arm; and a cutting edge part secured to the lip part, wherein the bottom surface part includes a first curved surface part having a shape curved at a predetermined first curvature radius when viewed from the side, and a second curved surface part that is positioned closer to the back surface part than the first curved surface part, the second curved surface part being connected to the first curved surface part, the second curved surface part having a shape curved at a predetermined second curvature radius that is less than the first curvature radius when viewed from the side, a center of the predetermined first curvature radius of the first curved surface part is positioned to the outside of the main bucket body when viewed from the side, where a wrist radius is defined as a length of an imaginary line connecting a center of the aperture of the bracket and a tip of the cutting edge part when viewed from the side, and a reference curved surface is defined as an imaginary curved surface that is in contact with the first curved surface part at the edge of the first curved surface part positioned on the lip part side and that has a shape that is curved at a curvature radius having the same length as the wrist radius when viewed from the side, the first curved surface part is arranged along the reference curved surface or above the reference curved surface in a state where the imaginary line is arranged horizontally and the bottom surface part is positioned below the imaginary line, and a connecting part between the first curved surface part and the second curved surface part is positioned more toward the lip part than a portion of the bottom surface part that is positioned lowest on the bottom surface part when viewed from the side, in a state in which the imaginary line is arranged horizontally and the bottom surface part is position below the imaginary line, wherein the center of the predetermined first curvature radius of the first curved surface part is positioned higher than the aperture and the imaginary line.

2. The bucket according to claim 1, wherein the main bucket body further includes a linearly shaped front surface part when viewed from the side and is positioned between the lip part and the first curved surface part, and a length of the front surface part is less than the length of the first curved surface part in a direction along the lip part as viewed from the side.

3. The bucket according to claim 1, wherein a relationship $0.59 \leq r/d \leq 1.0$ is satisfied, where d is the wrist radius and r is the predetermined first curvature radius.

4. The bucket according to claim 3, wherein a relationship $0.8 \leq r/d \leq 1.0$ is satisfied.

5. The bucket according to claim 1, wherein an angle formed by the imaginary line and the back surface part is an obtuse angle when viewed from the side.

6. The bucket according to claim 1, wherein the center of the predetermined first curvature radius of the first curved surface part is positioned rearward of the aperture.

7. A work vehicle comprising:

a main vehicle body;

a boom attached to the main vehicle body;

an arm attached to the boom; and the bucket according to claim 1 attached to the arm.

* * * * *